US005771661A

United States Patent [19]

Martin

[11] Patent Number: 5,771,661

[45] Date of Patent: Jun. 30, 1998

[54] MACHINE FOR RELEASING A BALE, PARTICULARLY A BALE OF TOBACCO, FROM A PACKAGE

[75] Inventor: Mario Martin, Treviso, Italy

[73] Assignee: Comas S.p.A., Silea, Italy

[21] Appl. No.: 766,457

[22] Filed: Dec. 12, 1996

[30] Foreign Application Priority Data

Dec. 12, 1995 [IT] Italy ..... T095A1000

[51] Int. Cl.[6] ..... B65B 43/38

[52] U.S. Cl. ..... 53/382.1; 414/422; 414/420

[58] Field of Search ..... 53/492, 382.1, 53/382.2, 381.1; 414/422, 420

[56] References Cited

U.S. PATENT DOCUMENTS

| | | | |
|---|---|---|---|
| 3,670,912 | 6/1972 | Dunbar | 414/420 |
| 4,548,539 | 10/1985 | Nagashino | 53/382.1 |
| 4,936,816 | 6/1990 | Blumle et al. | 53/382.1 |
| 4,986,718 | 1/1991 | Kumata et al. | 414/420 |
| 5,371,938 | 12/1994 | Martin . | |
| 5,463,841 | 11/1995 | Hayakawa et al. | 53/492 |

FOREIGN PATENT DOCUMENTS

| | | | |
|---|---|---|---|
| 0254185 | 2/1988 | Germany | 414/420 |
| 5221420 | 8/1993 | Japan | 53/492 |

*Primary Examiner*—John Sipos
*Assistant Examiner*—Gene Kim
*Attorney, Agent, or Firm*—Sughrue, Mion, Zinn, Macpeak & Seas, PLLC

[57] ABSTRACT

A machine for releasing a bale, particularly a bale of tobacco from a package, comprises a structure movable along an upright and having two arms with rotatable gripping devices for gripping, lifting and rotating a packaged bale so that the block of tobacco can be released from the packaging box, and the empty box can be transferred to a discharge area.

17 Claims, 9 Drawing Sheets

MACHINE FOR RELEASING A BALE, PARTICULARLY A BALE OF TOBACCO, FROM A PACKAGE

DESCRIPTION

The present invention relates to a machine for releasing a bale, particularly a bale of tobacco, packaged in a parallelepipedal box of cardboard or the like, of which at least one principal face has a plurality of articulated wings or flaps restrained in a folded closure position by at least one strap or the like fastened around the box, and in which the surface of the bale is covered by a protective sheet or wrapper beneath the flaps.

Figure 1:
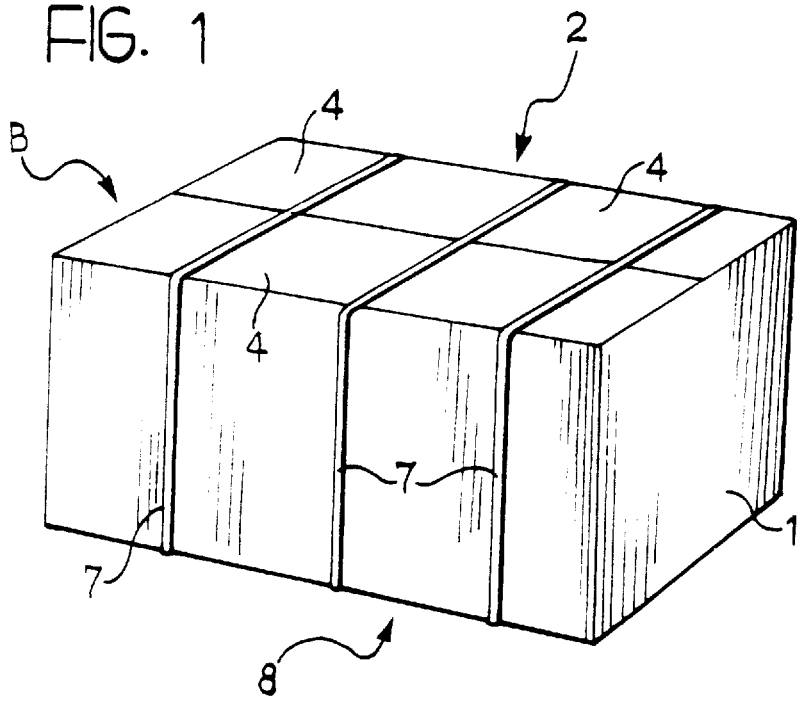
Figure 2:
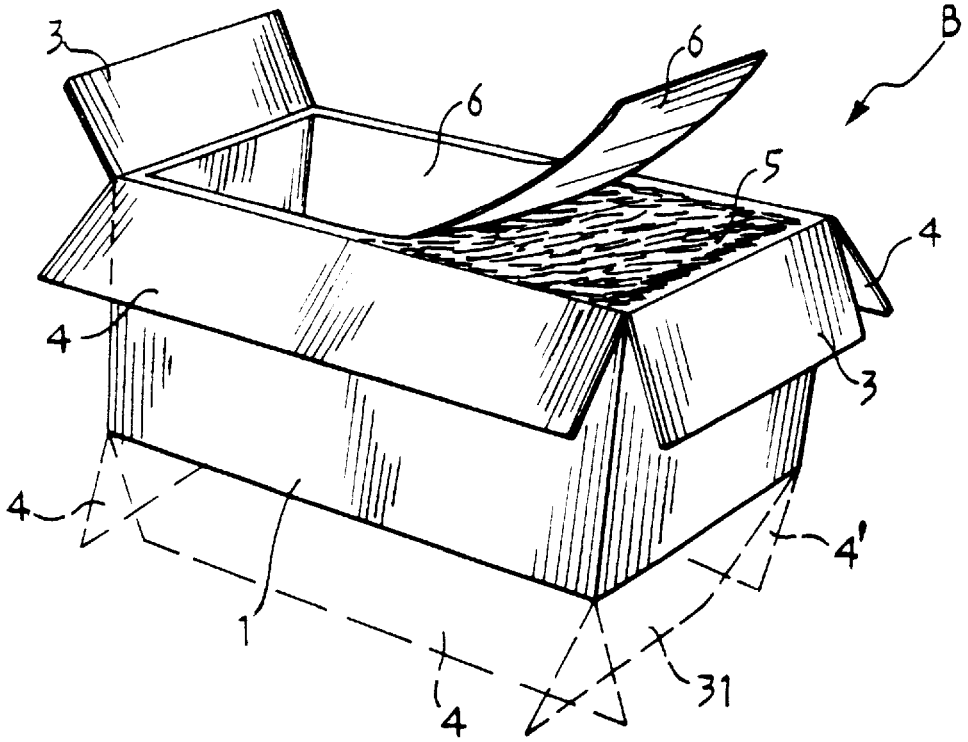

A bale of tobacco packaged in this manner is shown in FIGS. 1 and 2 of the appended drawings.

In these drawings, the parallelepipedal packaging box of cardboard or the like is indicated 1. The box is of conventional type and at least one principal face 2 thereof has four wings or flaps 3, 4 articulated on corresponding sides of this face. In FIG. 2, the flaps 3, 4 are shown in the unfolded, open position. A bale of compressed tobacco 5 is disposed in the box 1 and the upper surface of the bale is covered by a protective sheet 6. Alternatively, the bale 5 may be enclosed in a protective wrapper of, for example, nylon. During packaging, the smaller wings or flaps 3 are closed first and the larger wings or flaps are then closed onto them and, finally, straps or the like, indicated 7 in FIG. 1, are fastened around the box.

The box 1 is of conventional type and its lower face 8 opposite the principal face 2 may also have a plurality of closure wings or flaps 3', 4', shown by broken lines in FIG. 2.

When bales of tobacco packaged as described above reach a plant for the subsequent processing of the tobacco, they have to be released from the packaging box.

According to the prior art, this "stripping" of the bales is conventionally carried out manually.

The object of the present invention is to provide a machine which can release bales packaged in the manner described above for subsequent processing.

These and other objects are achieved according to the invention by a machine the principal characteristics of which are defined in the appended claim 1.

Figure 3:
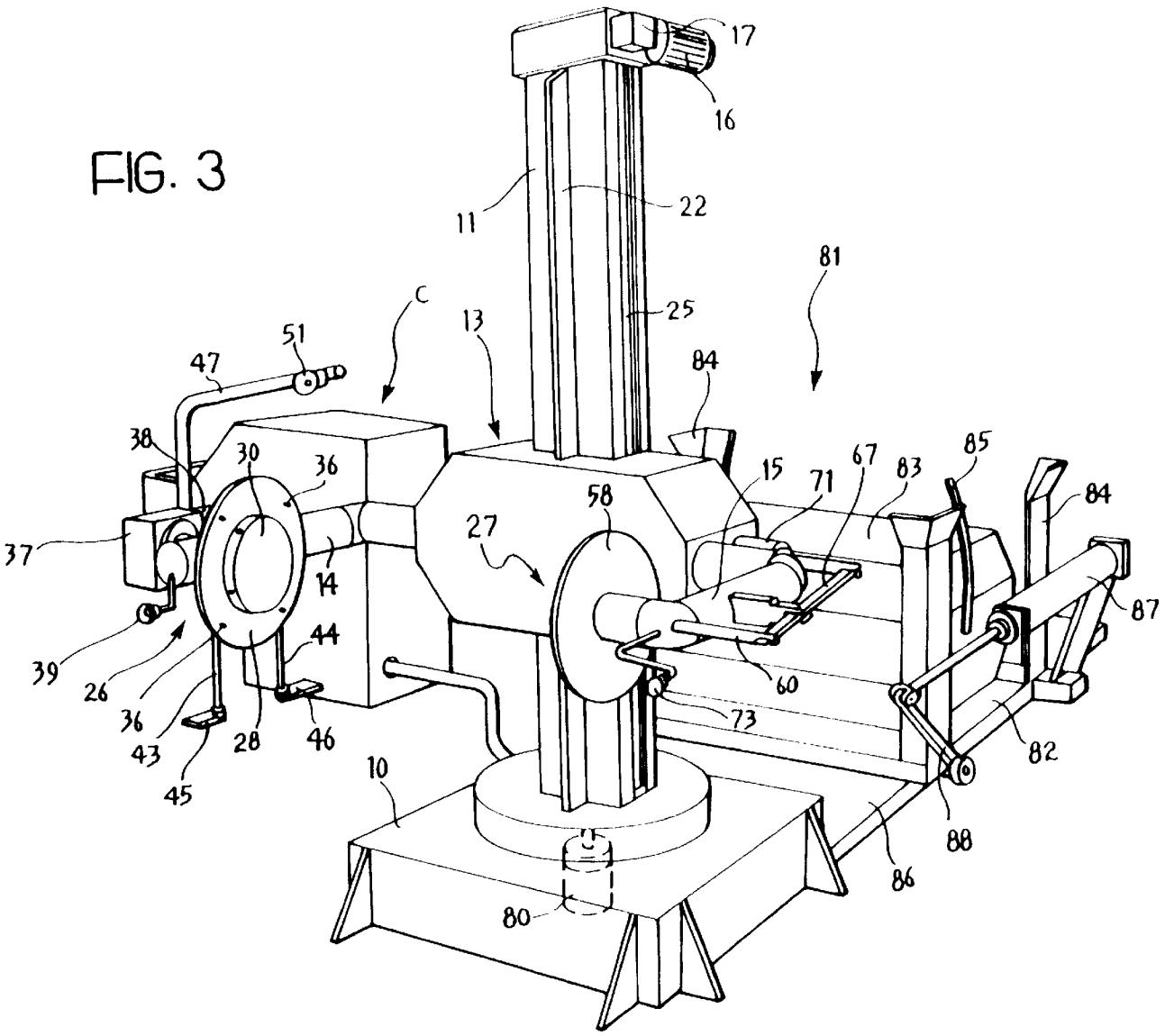
Figure 4:
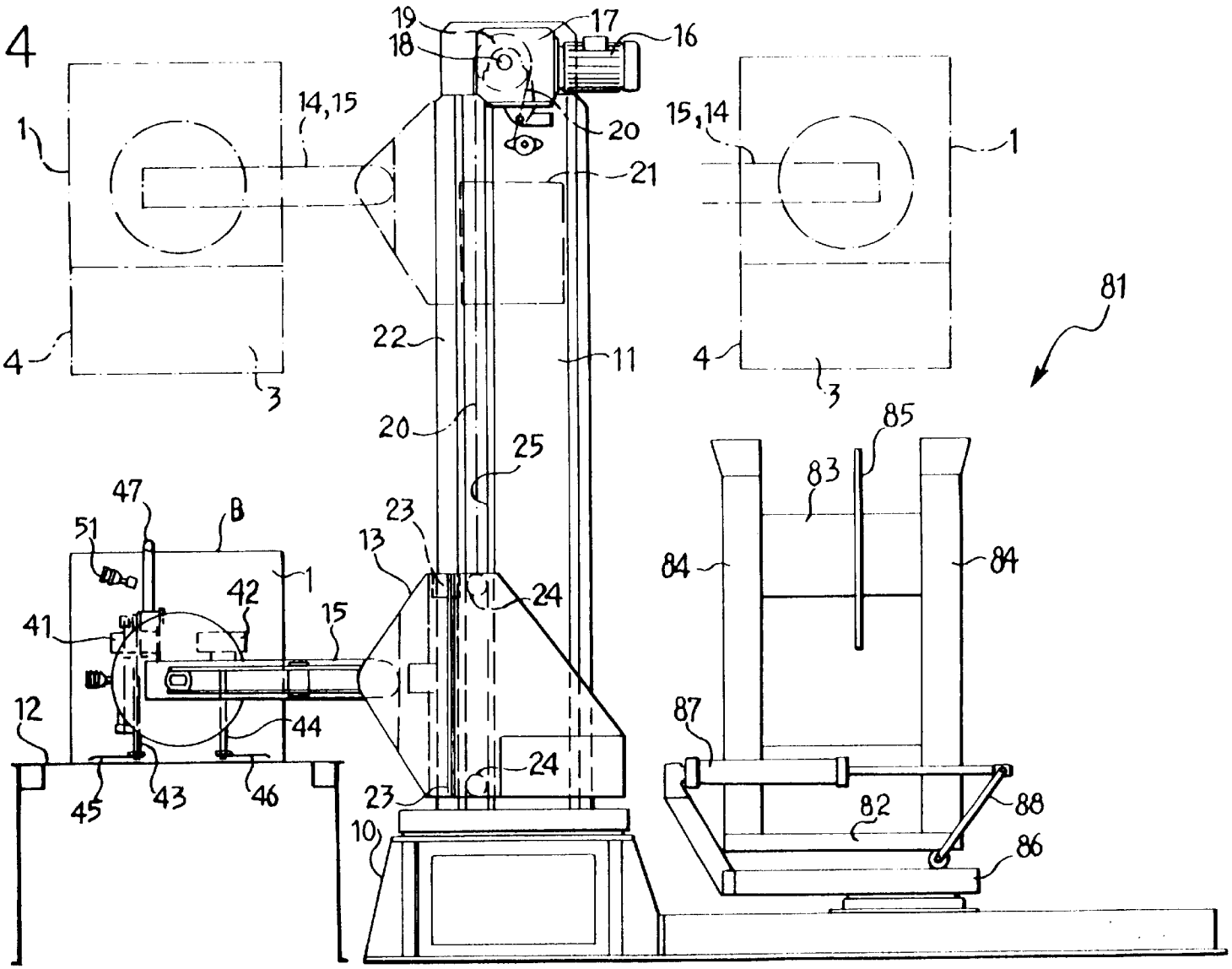
Figure 5:
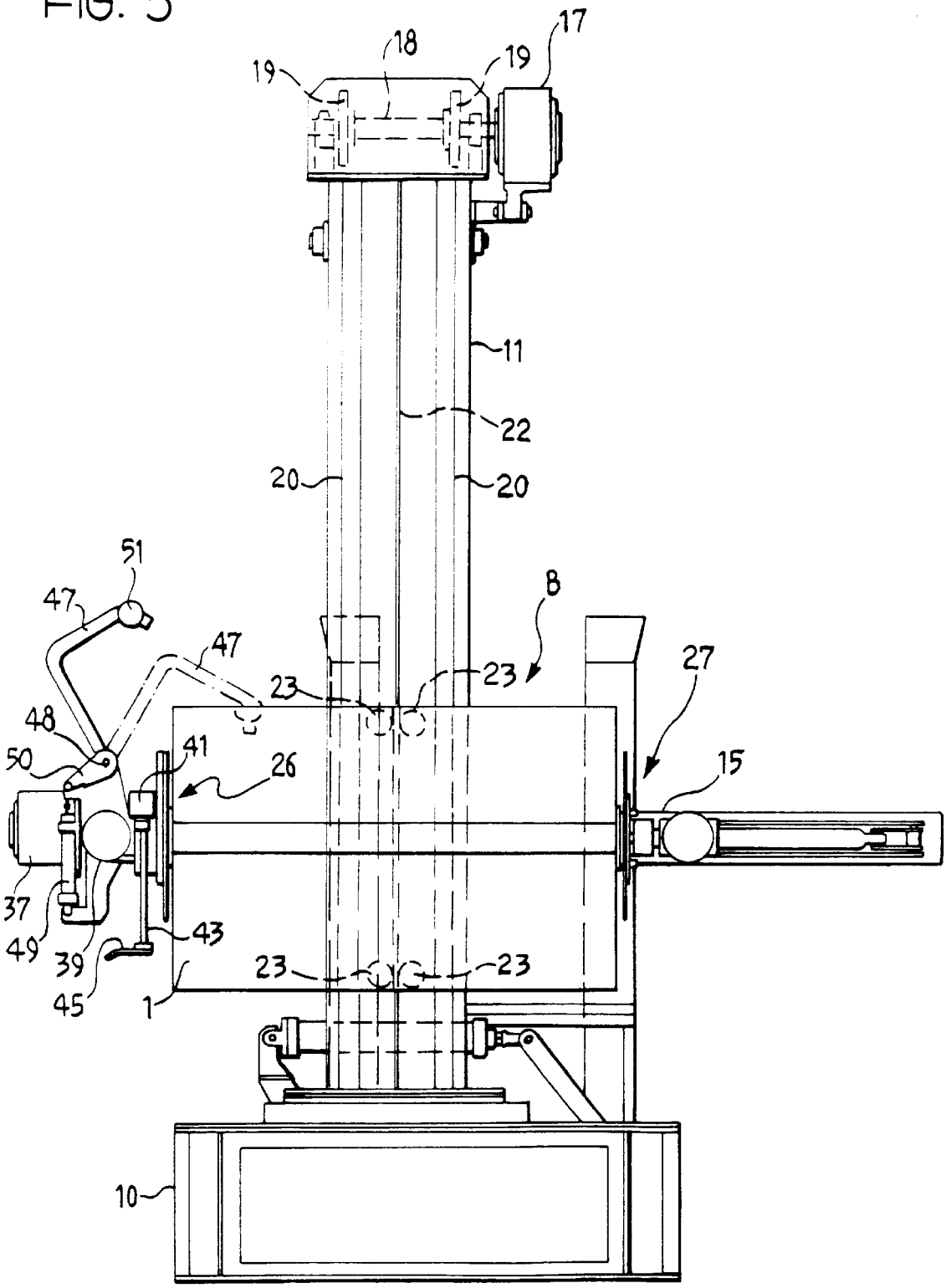
Figure 6:
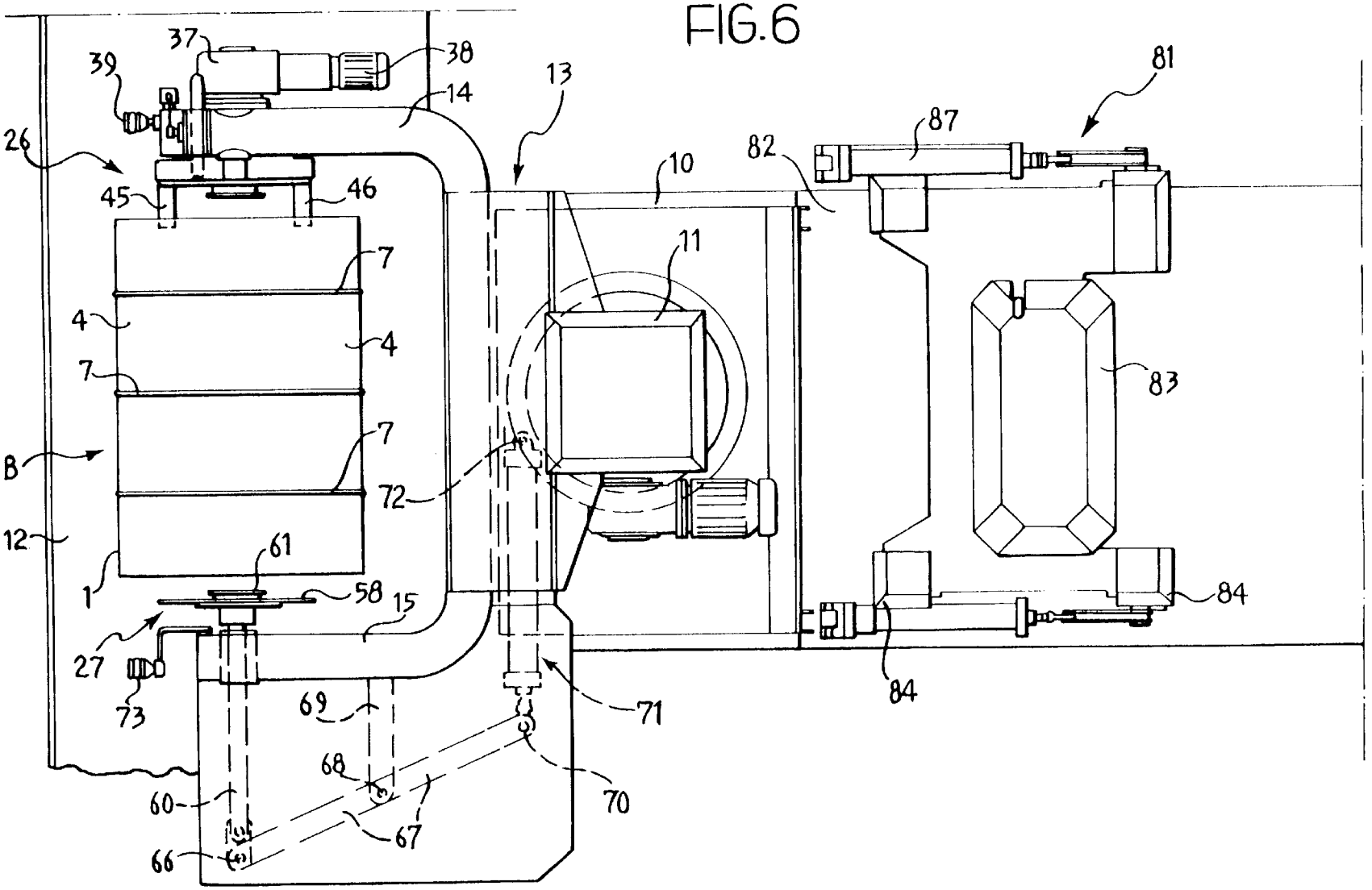
Figure 7:
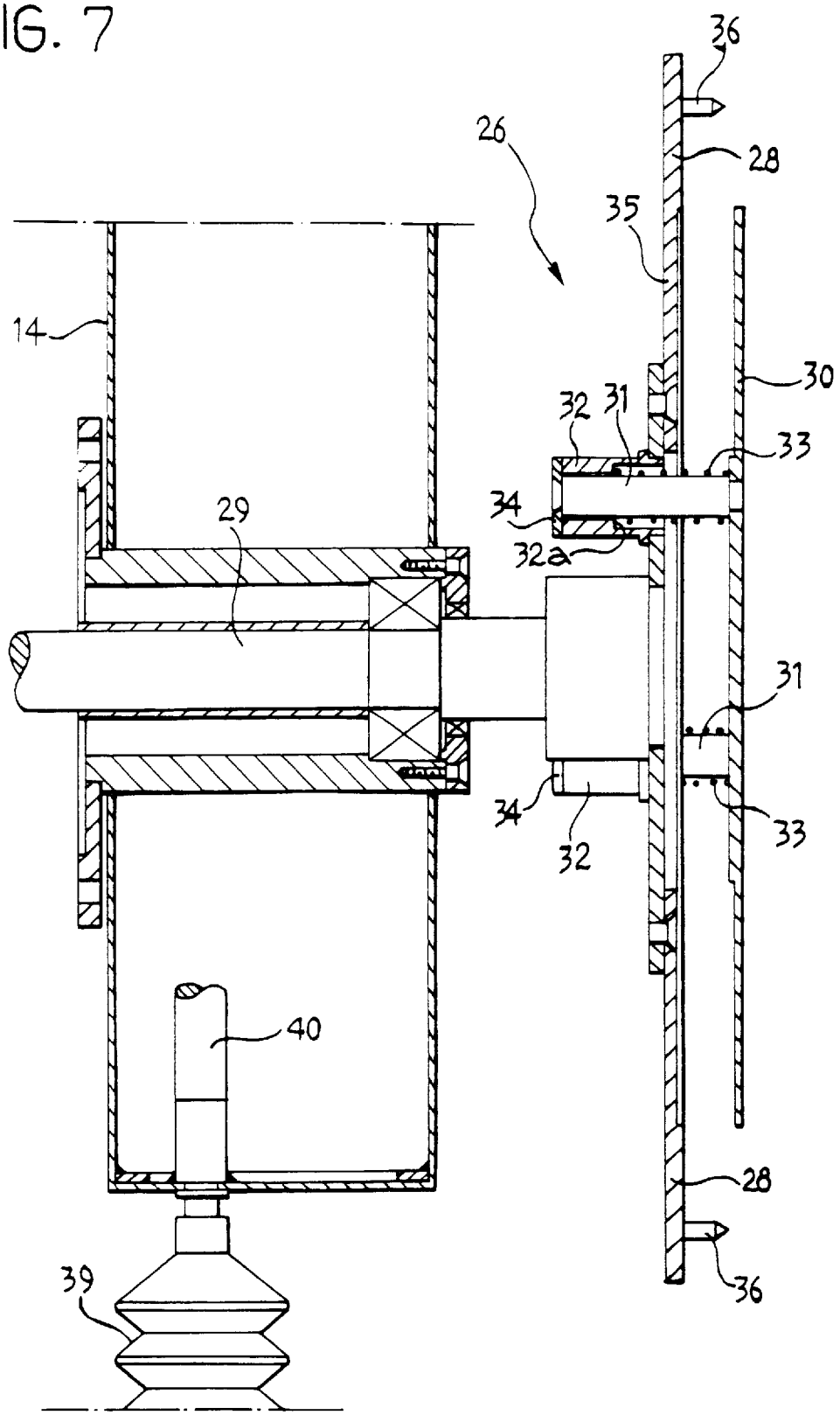
Figure 8:
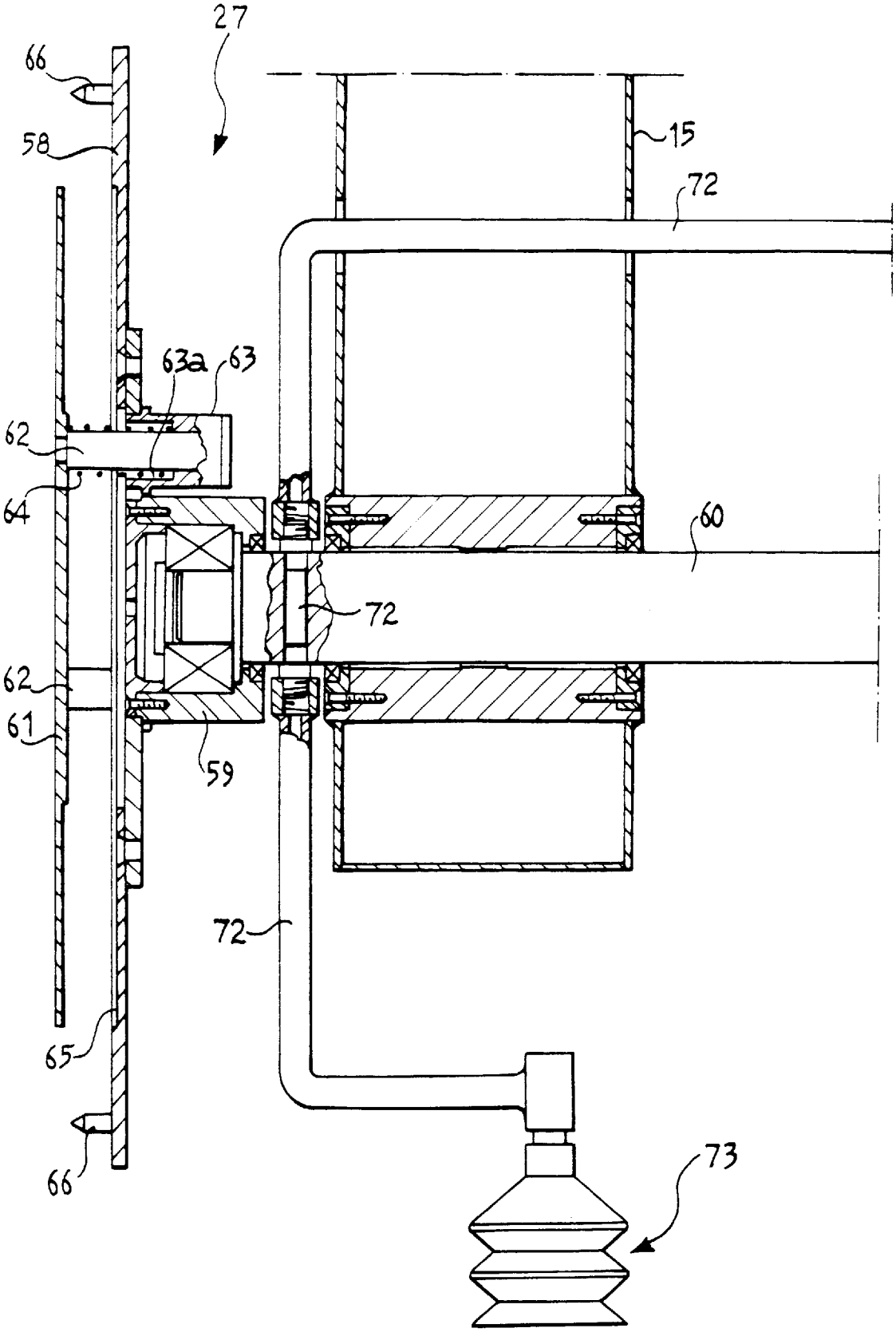

Further characteristics and advantages of the invention will become clear from the following detailed description, given purely by way of non-limiting example with reference to the appended drawings, in which:

FIGS. 1 and 2, which have already been described, show a bale of tobacco with its package, FIG. 3 is a partial perspective view of a machine according to the invention, FIG. 4 is a side view of the machine of FIG. 3, FIG. 5 is a front view of the machine, FIG. 6 is a view of the machine from above, FIGS. 7 and 8 are partial sections showing gripping devices which form part of the machine of the preceding drawings, and FIGS. 9 to 18 are schematic illustrations of part of the machine according to the invention in successive conditions or stages of the operating cycle.

With reference in particular to FIGS. 3 to 6, a machine according to the invention comprises a stationary base 10 on which a pillar-like upright 11 is mounted rotatably.

As can be seen in FIGS. 4 to 6, a working area, in which a horizontal conveyor 12 of known type is disposed, is defined in front of the upright 11. In operation, the conveyor 12 transports a packaged bale B and arranges it in a predetermined position shown in FIGS. 4 and 6 in front of the upright 11.

A movable structure 13, from which two fixed lateral arms 14 and 15 extend, is mounted for moving vertically along the upright.

An electric motor 16, fixed to the top of the upright 11, is coupled by means of a reduction unit 17 to a shaft 18 mounted rotatably at the top of the upright (see FIGS. 3 and 5). The shaft 18 carries two pulleys 19 around which respective chains or cables 20 extend and are connected at one end to the movable structure 13 and at the other end to a counterweight 21 (FIG. 4) mounted for moving vertically inside the upright 11.

The principal front face of the upright 11 has a central vertical rail 22 (FIGS. 3 to 5) on the sides of which pairs of opposed rollers 23 mounted inside the movable structure 13 run (FIGS. 4 and 5).

The movable structure 13 advantageously also includes pairs of lateral rollers 24 (FIG. 4) slidable in slot-like guides 25 provided on the lateral faces of the upright 11 (FIGS. 3 and 4).

The free ends of the arms 14 and 15 fixed to the movable structure 13 carry horizontally opposed and facing gripping devices, generally indicated 26 and 27.

As can best be seen in FIG. 7, the gripping device 26 comprises a gripping ring 28 fixed to a shaft 29 mounted rotatably in the end of the arm 14. A circular thrust plate 30 associated with the gripping ring 28 faces towards the other gripping device 27. Rods 31, connected to the rear face of the plate 30, extend through the gripping ring 28 and into bushes 32 fixed behind the ring. An annular shoulder 32*a* is formed inside each bush 32 facing the thrust plate 30. A helical spring 33 is disposed around each rod 31 between the shoulder 32*a* of the associated bush 32 and the rear face of the thrust plate 30.

A stop head 34 which is fixed to each rod 31 at the opposite end to the plate 30 extends from the associated bush 32.

The arrangement described above is such that, at rest, the helical springs 33 tend to push on the plate 30 and keep it spaced from the plane of the gripping ring 28, as shown in FIG. 7.

A cavity 35 of a shape and depth corresponding to the shape and thickness, respectively, of the plate 30 is formed in the face of the gripping ring 28 which faces the plate 30. The plate can therefore be brought into engagement in the cavity 35 in the gripping ring 28 against the action of the springs 33. When the plate 30 is engaged in the cavity 35 in the ring 28, its opposite face to the arm 14 is substantially flush with the surface of the gripping ring 28.

A plurality of spikes 36 projects from the surface of the gripping ring 28 facing the other gripping device 27, radially outside the plate 30.

An electric motor 38 is coupled to the shaft 29 by means of a reduction unit 37. This motor-reduction unit is fixed to the arm 14 of the movable structure 13 (see FIGS. 3 to 5).

As can be seen in particular in FIG. 7, a suction bellows 39 is connected to an opening formed in the end of the arm 14 and is connected to a vacuum source (not shown) by means of a pipe 40 which extends inside the arm.

As shown in FIGS. 3 to 5, two pneumatic actuators 41 and 42 are connected to the gripping ring 28, and respective rotatable shafts 43 and 44, substantially aligned in a plane parallel to the plane of the gripping ring 28, extend from the actuators. The lower ends of these shafts carry respective restraining members 45 and 46 in the form of plates lying in a horizontal plane. When the machine is in the rest condition, these members extend at a level below the lower edge of the gripping ring 28.

A bent rigid suction pipe 47, also connected to the end of the arm 14, is pivotable about a horizontal axis 48 (FIG. 5) by means of a pneumatic cylinder 49 and a transmission lever 50. The free end of this pipe carries a bellows suction nozzle 51 oriented transverse the pipe, as can be seen in FIGS. 3 to 5.

With reference to FIG. 8, the gripping device 27 comprises a gripping ring 58 fixed to a tubular hub 59 which in turn is mounted for rotating freely about an end of a horizontal rod 60 extending through the end of the arm 15.

A thrust plate 61 parallel to and facing the thrust plate 30 of the other gripping device 26 is associated with the gripping ring 58. Rods 62 connected to the rear face of the plate 61 are movable through guide bushes 63 fixed to the ring 58. Respective shoulders 63*a* are defined in the bushes and corresponding helical springs 64 disposed around the rods 62 bear against the shoulders 63*a*. The gripping ring 58 also has a cavity, indicated 65, which can house the plate 61 when it is squeezed towards the ring against the action of the springs 64.

The ring 58 has a plurality of spikes 66 facing towards the other gripping device.

The rod 60 on which the gripping device 27 is mounted rotatably is movable axially through the end of the arm 15.

The opposite end of this rod to the gripping device 27 is articulated at 66 (FIG. 6) to one end of a rocker arm 67 pivotable at 68 on an appendage 69 which extends from the arm 15.

The other end of the rocker arm is articulated at 70 to the rod of an actuator cylinder 71 the casing of which is articulated to the movable structure 13 at 72.

The gripping device 27 can be moved, by means of the cylinder 71, from a retracted position, shown in FIG. 6, in which it is disposed at a distance greater than the length of a packaged bale B from the other gripping device 26, to an advanced position, in which it is positioned at a distance therefrom which is equal to, but preferably slightly less than, the length of a bale B.

With reference once again to FIG. 8, a pneumatic pipe 72 extends through the rod 6 in order to supply a vacuum to a bellows nozzle 73.

This nozzle, like the nozzles 39 and 51 described above, is connected to a vacuum source of known type, not shown.

A control and operating unit, generally indicated C in FIG. 3 and associated with the machine described above, is arranged to control, in a coordinated manner, the operation of the electric motor 16 which brings about the movement of the movable structure 13, the operation of the cylinder 71 which controls the movement of the gripping device 27, the electric motor 38 which can rotate the gripping device 26, the pneumatic actuators 41 associated with the retaining members 45 and 46, and the vacuum source connected to the connectors 39, 51 and 73.

Also connected to the control unit C are sensors for detecting the position of the movable structure 13 relative to the upright 11 in order that the structure can be positioned in predetermined positions by means of the motor 16 during each operating cycle.

An operating cycle will now be described with particular reference to FIGS. 9 to 18.

Figure 9:
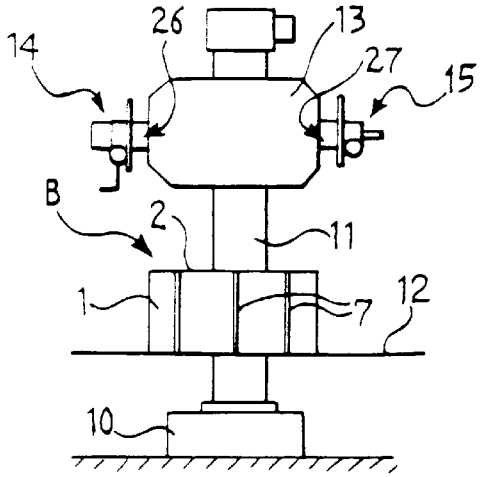
Figure 10:
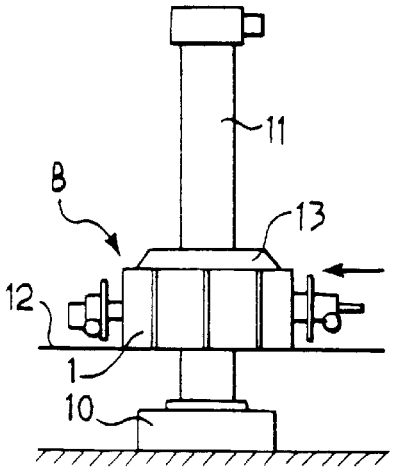

At the beginning of an operating cycle, the control unit C positions the movable structure 13 in a raised position, as shown in FIG. 9. The movable gripping device 27 is in the retracted position. In this condition, the conveyor 12, which is also controlled by the unit C, transports a packaged bale B into the working area and places it in front of the upright 11 in the region between the planes in which the gripping devices 26 and 27 are disposed. The bale B is arranged with its principal face 2 and the respective wings or flaps 4 lying in a horizontal plane.

The unit then causes the movable structure to descend towards a lowered position (FIG. 10) in which the gripping devices 26 and 27 face the end faces of the bale B.

Figure 11:
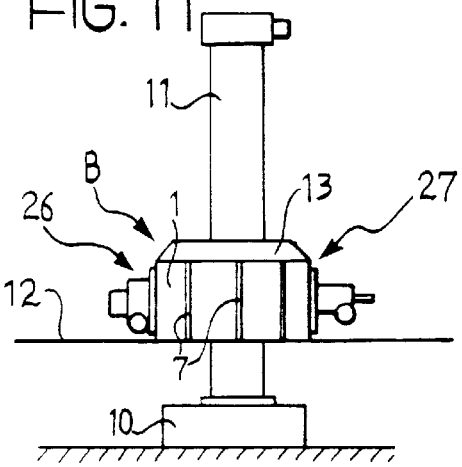

The unit C then causes pressurized fluid to be supplied to the cylinder 71 so as to cause the gripping device 27 to be moved towards the bale B. This gripping member causes the bale B to slide on the conveyor 12 until the bale is brought into engagement with the gripping device 26 (FIG. 11). In particular, the packaged bale B is compressed slightly between the gripping devices 26 and 27 and the spikes 36 and 66 of their gripping rings 28 and 58 penetrate the vertical end walls of the box 1 of the bale. The thrust plates 30 and 61 of the two gripping devices are pressed and are disposed flush with the associated gripping rings 28 and 58, against the action of the associated reaction springs 33 and 64.

Figure 12:
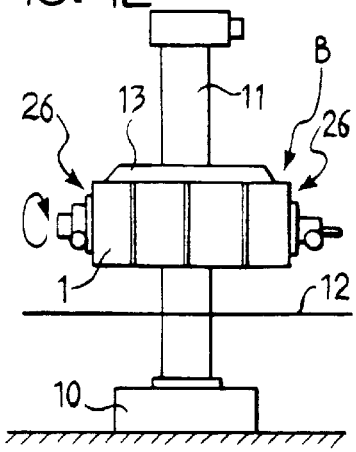

The control unit C then lifts the movable structure 13 and the bale B clamped between the gripping devices 26 and 27, as shown in FIG. 12, to a height such as to enable the bale B to rotate without interference with the underlying conveyor 12.

Figure 13:
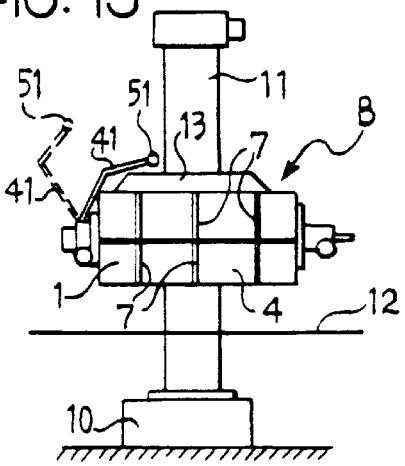
Figure 14:
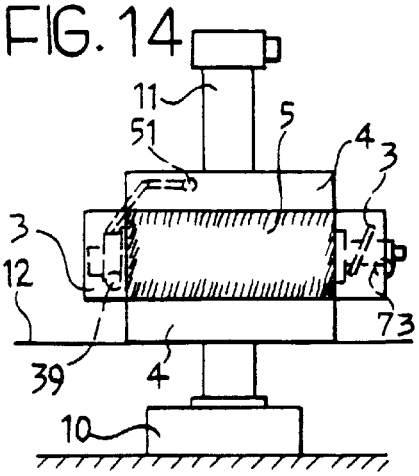

The unit C then activates the electric motor 38 associated with the gripping devices 26, rotating the bale about the common horizontal axis of the gripping devices 26 and 27, so as to arrange the packaged bale B with its principal face 2 and the respective wings or flaps 4 in an essentially vertical plane, as shown in FIG. 13. In this condition, the control unit C causes the suction pipe 47 to pivot (clockwise as seen in FIG. 13) so as to place the nozzle 51 in a position between the planes of the gripping devices 26 and 27.

With the bale restrained in the position shown in FIG. 13, a n operator can cut and remove the straps 7 or the like which fasten the box 1 of the bale and unfold the flaps 3 and 4 which close its opening. In particular, the flaps 3 and the upper flap 4 are disposed against the suction nozzles 39, 73 and 51 which restrain them in position, owing to the vacuum supplied thereto. The lower flap 4 remains in the folded-down condition simply by the effect of its own weight. The operator can thus easily remove the protective sheet 6 (FIG. 2) which covers the surface of the tobacco 5 or tear and remove the portion of the nylon wrapper of the bale 5 facing the face or opening 2 of the box 1.

The operator then recloses the flaps 3 and 4 of the box 1.

Figure 15:
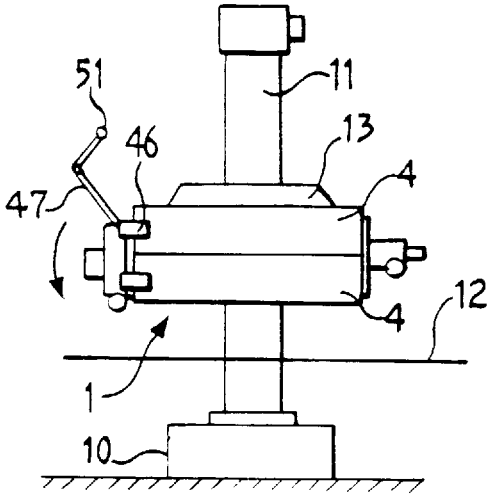

The control unit C then rotates the restraining members 45, 46 which are arranged in the position shown in FIG. 15 in which they hold the wings or flaps 3 and 4 of the box in the closed position. The unit C also pivots the suction pipe 47 to return it to a position in which it does not interfere with the subsequent rotation of the box 1 (FIG. 15).

Figure 16:
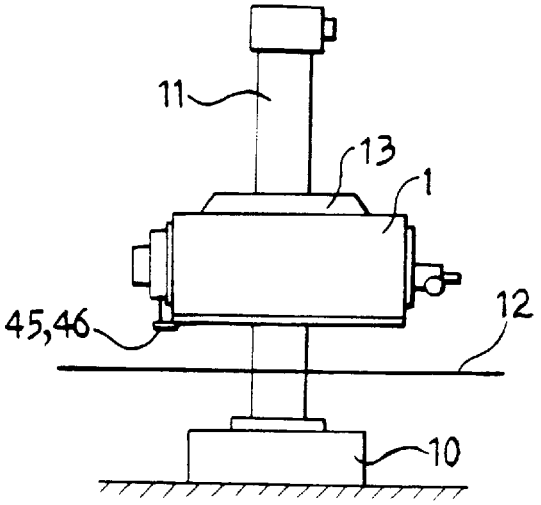

By activating the electric motor 38, the unit C now causes the box 1 to rotate so that the flaps 3 and 4, which are restrained in the closed condition, are arranged horizontally facing the underlying conveyor 12 as shown in FIG. 16.

Figure 17:
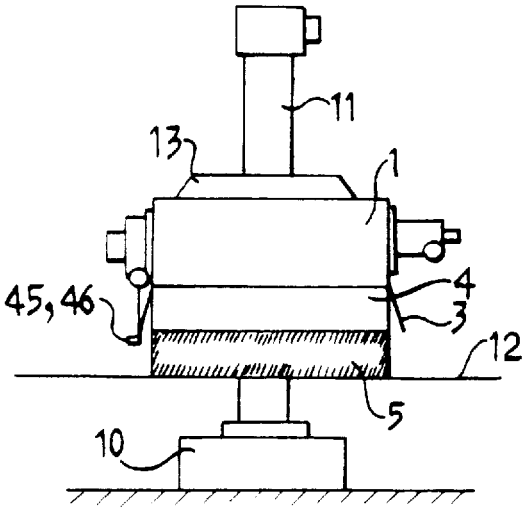

The unit C then rotates the restraining devices 45 and 46 so that they are disengaged from the flaps 4 of the box which can thus unfold downwardly as shown in FIG. 17.

The block of tobacco 5 contained in the box can then fall by gravity onto the conveyor 12. To facilitate its fall, the unit C may be arranged to bring about a small movement of the gripping device 27 away from the gripping device 26.

Figure 18:
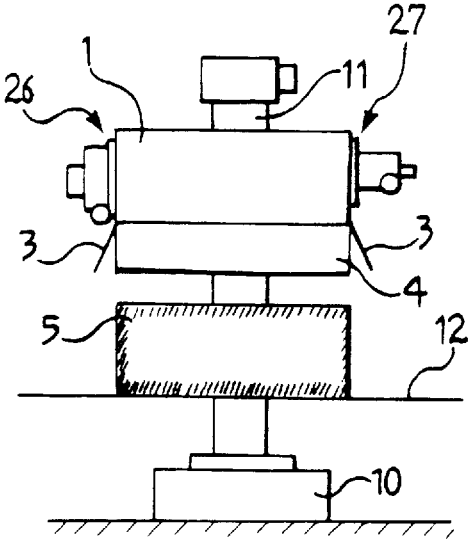

The unit C then raises the movable structure 13 between the gripping devices 26 and 27 of which solely the empty box 1 is held (FIG. 18).

The conveyor 12 is then operated in order to transfer the block of tobacco 5 to subsequent work stations (not shown).

The upright 11 is advantageously, but not necessarily, mounted on the base structure 10 so as to be rotatable about a vertical axis. An electric motor 80 (FIG. 3) controlled by the unit C is advantageously mounted inside the base 10 and can be operated in order to rotate the upright 11 and the structure 13 connected thereto.

The activation of the electric motor 80 after the condition shown in FIG. 18 has been reached enables the empty box 1 to be transferred to a discharge area located, for example, on the opposite side of the upright 11 to the conveyor 12 (see also FIG. 4).

After the empty box has been brought above the discharge area, the control unit C moves the gripping device 27 to the retracted position so that the spikes 66 of its gripping ring 58 are disengaged from the box. At the same time, the box is disengaged from the spikes 36 of the other gripping device 26 under the action of the thrust plate 30, pushed by the associated springs 33. The empty box 1 can thus fall into the discharge area by gravity.

The control unit C returns the upright 11 to the initial position (FIG. 9) for the start of a new working cycle.

A receiving station such as that generally indicated 81 in FIGS. 3 and 4 may advantageously be provided in the discharge area.

This receiving station comprises a horizontal base platform 82 to which a shaped core 83 having transverse dimensions smaller than those of the space inside the box and a height greater than the depth of the box is centrally fixed.

Restraining elements 84 are fixed on the platform 82 around the core 83 and, in the embodiment illustrated, are essentially upright and are arranged in positions spaced apart by distances greater than the length and the width of the box.

The upper end of the core 83 is advantageously tapered upwardly to enable the box to slip down more easily onto the core by falling. Moreover, the upper ends of the restraining elements 84 may advantageously be flared outwardly and upwardly so that the empty box can slip down more easily between the restraining elements and the core 83.

Movable spreader bars 85 are advantageously connected to two opposite sides of the core 83 corresponding to the smaller end faces of the box 1 and extend substantially upwardly from the central region of the core. These spreader bars can be moved outwardly by means of actuator devices inside the core 83, for example, pneumatic actuators, in order to open and unfold the flaps 3' and 4' of the box 1 opposite the flaps 3 and 4 of the face of the box which was previously opened.

The upper ends of the spreader bars 85 are advantageously curved towards one another.

The receiving station 81 may be disposed in the position relative to the upright 11 shown in FIGS. 3 and 4, in which it can receive an empty box after the upright 11 has been rotated through 180° from the position in which its arms 14 and 15 extend above the conveyor 12.

Alternatively, the receiver station 81 may normally be arranged in a position other than that shown and may be brought to the position shown only when the upright 11 is rotated towards the discharge area. This possible movement of the receiver station 81 can be coordinated with the rotation of the upright 11 by means of a mechanical drive transmission, advantageously driven by the same motor 80 which is associated with the upright 11.

The platform 82 of the receiving station may advantageously be mounted so as to be tiltable about a horizontal axis relative to a base structure 86, for example, by means of drive cylinders 87 and associated transmission linkages 88. The tilting of the receiving structure 81 enables the empty and completely unfolded box to be placed in an inclined position to facilitate its removal from the receiving structure 81 by means of a conventional conveyor for transporting it to a distant storage station.

Naturally, the principle of the invention remaining the same, the forms of embodiment and details of construction may be varied widely with respect to those described and illustrated purely by way of non-limiting example, without thereby departing from the scope of the present invention as defined in the annexed Claims.

What is claimed is:

1. A machine for releasing a bale, a bale of tobacco, from a package comprising a parallelepipedal box of cardboard or like material, said box including at least one principal face having a plurality of articulated wings or flaps restrained in a folded closure position by at least one strap or like retaining means fastened around the box, and in which the bale is covered by a protective sheet or is enclosed in a wrapper beneath said flaps, wherein the machine comprises:

a conveyor and support device for supporting a packaged bale in a predetermined position in a working area with the principal face of said box in a horizontal plane, an upright disposed in front of said working area, a movable structure movable vertically along said upright, a pair of arms fixed to said movable structure and carrying respective rotatable, horizontally-facing and spaced-apart gripping devices, first drive means for moving said movable structure along said upright, second drive means carried by said movable structure for bringing about relative movement of the gripping devices between a spaced-apart condition in which the gripping devices are separated by a distance greater than the length of a packaged bale and a close-together condition, in which the gripping devices are separated by a distance less than or equal to the length of a packaged bale, third drive means for rotating at least one of said gripping devices about a horizontal axis, restraining means carried by at least one of said pair of arms and movable between a rest position and a working position, and control and operating means connected to said first, second and third drive means and to said restraining means for positioning of the gripping devices in the spaced-apart condition and the positioning of the movable structure in a raised position in which a packaged bale can be placed in the predetermined position in the working area;

downwardly moving of the movable structure to a lowered position in which the gripping devices face two end faces of the packaged bale;

moving of the gripping devices to the close-together condition in order to grip the end faces of the packaged bale;

lifting of said movable structure from the lowered position and the operation of said third drive means so as to rotate the packaged bale gripped between the gripping devices, thereby arranging the bale in a position in which the wings or flaps of the packaging box are in a substantially vertical plane in order that said at least one strip or like retaining means being removed, the wings or flaps of the face of the box being unfolded, the protective sheet or wrapper being removed, and the wings or flaps being reclosed;

moving of the restraining means to the working position in order to restrain the wings or flaps substantially in the closure position;

rotating of the box and of the bale contained therein towards a position in which the wings or flaps are in a substantially horizontal plane and facing downwardly; and moving of the restraining means to the rest position in which they release the wings or flaps of the box so that the bale is free to slide vertically by gravity towards and onto the conveyor and support device away from the box.

2. A machine according to claim 1, wherein one of said gripping devices is connected to the associated arm of the movable structure so as to be movable horizontally relative to the arm under the action of the second drive means.

3. A machine according to claim 2, wherein said one gripping device is connected to said arm so as to be rotatable freely about a horizontal axis, and the other of said gripping devices is connected rotatably to the corresponding other arm of the movable structure and can be rotated in a controlled manner by the third drive means.

4. A machine according to claim 1, wherein at least one of said gripping devices comprises a ring having a plurality of spikes which face towards the other gripping device and can penetrate the walls of the box.

5. A machine according to claim 4, wherein said at least one gripping device comprises a thrust device including a plate movable towards the other gripping device relative to the associated gripping ring under the action of associated resilient thrust means.

6. A machine according to claim 1, wherein said restraining means comprise a pair of shafts supported rotatably by one of said gripping devices, said shafts carrying at their respective ends respective plate-like members which can engage and restrain a wing or flap of the box substantially in the folded closure position.

7. A machine according to claim 6, wherein each shaft of said pair of shafts includes a respective actuator for bringing about the rotation.

8. A machine according to claim 1, wherein said pair of arms are associated with vacuum restraining devices for restraining at least some of the wings or flaps of the box in the unfolded, open position.

9. A machine according to claim 1, wherein said first drive means comprise:

an electric motor fixed to said upright and coupled to a shaft bearing at least one pulley over which a flexible transmission member can run, the tranmission member having one end connected to the movable structure and the other end connected to a counterweight movable vertically along said upright.

10. A machine according to claim 1, wherein said upright has at least one vertical guide rail and said movable structure carries at least two opposed rollers which can run along opposite sides of the rail.

11. A machine according to claim 1, wherein said upright is supported by a stationary base structure so as to be rotatable about a vertical axis, fourth drive means being provided for rotating the upright about the axis, said control and operating means being also arranged, after the bale has slid under gravity onto the conveyor and support device, to bring about:

the rotation of the upright and of the empty box restrained between the gripping devices towards a discharge area, the movement of the gripping devices to the spaced-apart condition and the release of the box so that it falls by gravity into the discharge area, and the return of the upright to the initial position in front of the working area.

12. A machine according to claim 11, wherein said machine also comprises a box receiving station for arrangement in said discharge area for receiving empty boxes released by the gripping devices.

13. A machine according to claim 12, of which the boxes have a second principal face which is disposed opposite said at least one principal face and also has a plurality of articulated wings or flaps restrained in a folded, closure position, wherein said box receiving station comprises a platform on which a core and a plurality of restraining elements, spaced from the core, are fixed so that an empty box released by the gripping devices can slip with clearance between the core and the associated surrounding restraining elements.

14. A machine according to claim 13, wherein said core comprises movable spreader members for unfolding the flaps which close the second face of the box.

15. A machine according to claim 13, wherein said platform can be tilted, the machine including drive means for tilting said platform towards a position in which removal of an empty and unfolded box disposed between the core and the associated restraining elements is facilitated.

16. A machine according to claim 12, wherein said box receiving station is disposed on the opposite side of the upright from the conveyor and support device.

17. A machine according to claim 14, wherein said platform can be tilted, the machine including drive means for tilting said platform towards a position in which removal of an empty and unfolded box disposed between the core and the associated restraining elements is facilitated.

* * * * *